US008613173B2

(12) United States Patent
Ander et al.

(10) Patent No.: US 8,613,173 B2
(45) Date of Patent: Dec. 24, 2013

(54) SUSPENSION DEVICE FOR A FAçADE, AND FACADE

(75) Inventors: Emal Ander, Bad Salzuflen (DE); Dieter Röding, Bielefeld (DE)

(73) Assignee: Schuco International KG, Bielefeld (DE)

( * ) Notice: Subject to any disclaimer, the term of this patent is extended or adjusted under 35 U.S.C. 154(b) by 188 days.

(21) Appl. No.: 12/747,533

(22) PCT Filed: Oct. 22, 2008

(86) PCT No.: PCT/EP2008/064288

§ 371 (c)(1),
(2), (4) Date: Dec. 23, 2011

(87) PCT Pub. No.: WO2009/074390

PCT Pub. Date: Jun. 18, 2009

(65) Prior Publication Data

US 2012/0102860 A1 May 3, 2012

(30) Foreign Application Priority Data

Dec. 13, 2007 (DE) ..... 20 2007 017 424 U

(51) Int. Cl.
*E04H 1/00* (2006.01)

(52) U.S. Cl.
USPC ..... 52/235; 52/698

(58) Field of Classification Search
USPC ..... 52/235, 698, 705
See application file for complete search history.

(56) References Cited

U.S. PATENT DOCUMENTS

| | | | | | |
|---|---|---|---|---|---|
| 4,483,122 | A * | 11/1984 | Crandell | 52/747.1 |
| 4,570,401 | A * | 2/1986 | Uebel et al. | 52/235 |
| 5,323,577 | A * | 6/1994 | Whitmyer | 52/235 |
| 5,544,461 | A * | 8/1996 | Sommerstein | 52/235 |
| 6,098,364 | A * | 8/2000 | Liu | 52/506.08 |
| 7,043,884 | B2 * | 5/2006 | Moreno | 52/235 |
| 8,122,650 | B2 * | 2/2012 | Eickhof | 52/134 |
| 8,365,481 | B2 * | 2/2013 | Scully et al. | 52/235 |

FOREIGN PATENT DOCUMENTS

| | | |
|---|---|---|
| DE | 44 12 505 | 6/1955 |
| DE | 75 09 864 | 3/1975 |
| DE | 102 34 807 | 2/2004 |
| FR | 2140336 | 1/1973 |
| LU | 80 537 | 3/1979 |
| WO | 2007/031240 | 3/2007 |

OTHER PUBLICATIONS

Notification of Transmittal of the International Preliminary Report and the Written Opinion of The International Searching Authority for PCT/US2008/064288, Oct. 28, 2008 including the English Translation.

* cited by examiner

*Primary Examiner* — Mark Wendell
(74) *Attorney, Agent, or Firm* — Barnes & Thornburg LLP

(57) ABSTRACT

A suspension device for façade elements of a façade of a building. The suspension device includes suspending elements engaging in receiving regions of elements of the suspension device that are arranged on the building side. The elements of the suspension device arranged on the building side include at least one base element that is fastened to the building and an adjusting device that is adjustable on the base element.

22 Claims, 2 Drawing Sheets

Fig. 4
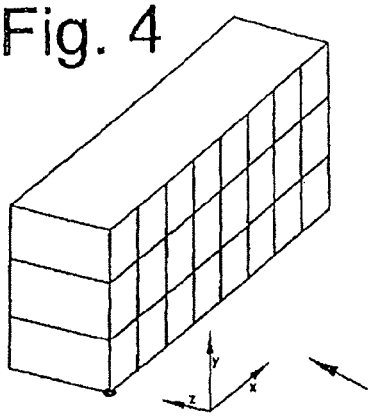
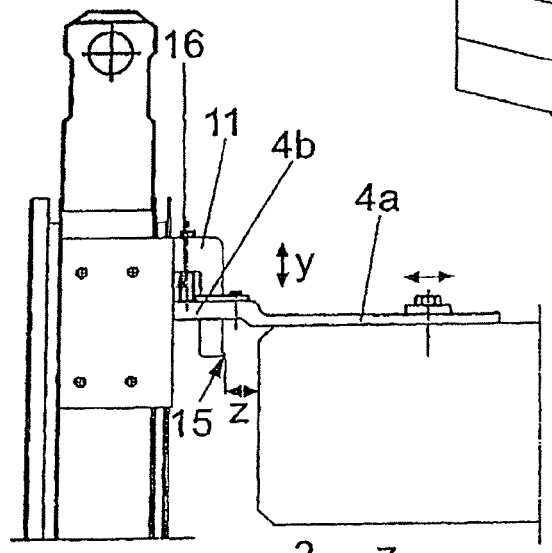
Fig. 2
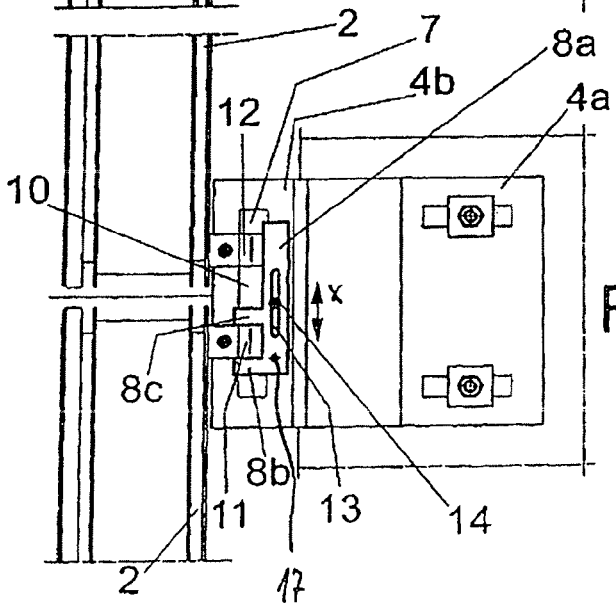
Fig. 3

SUSPENSION DEVICE FOR A FAçADE, AND FACADE

This application is a national stage of International Application PCT/EP2008/064288, filed Oct. 22, 2008 and claims benefit of and priority to German Patent Application No. 20 2007 017 424.1, filed December 13, the contents of both Applications being hereby incorporated herein by reference.

BACKGROUND SUMMARY

The present disclosure relates to a suspension device for a façade of a building. The suspension device for façade elements of a façade of a building includes suspending elements which engage in receiving portions of elements of the suspension device that are arranged on a building side or facade.

For façades having prefabricated elements, these elements are fastened to the floor ceilings, or floor slabs, of buildings by suspension devices.

German Patent Documents DE 44 12 505, DE 75 09 864, U.S. Pat. No. 4,483,122 or the German Patent Document of the same type, DE 102 34 807, disclose such suspension devices. However, the suspension devices known from the state of the art have the disadvantage that, constructively, their further developments require relatively high expenditures and their handling is relatively cumbersome.

The present disclosure is directed to a further development of the suspension devices of the above-mentioned type such that their construction and their handling are simplified.

The present disclosure therefore relates to a suspension device for façade elements of a façade of a building. The suspension device includes suspending elements engaging in receiving regions of elements of the suspension device that are arranged on the building side. The elements of the suspension device arranged on the building side include at least one base element that is fastened to the building and an adjusting device that is adjustable on the base element. Two of the receiving regions are constructed on the at least one base element and a position of a first of the receiving regions and a size of a second of the receiving regions is adjustable by the adjusting device. The first receiving region cooperates with a first of the suspending elements to form a fixed bearing and the second of the receiving regions cooperates with the second of the suspending elements to form a movable bearing.

Accordingly, the elements of the suspension device arranged on the building side have at least one base element fastened to the building and an adjusting device which can be adjusted on the base element and is designed for the position and/or the size of at least one of the receiving regions on the base element.

As a result, it becomes possible to adjust, depending on the situation, the receiving regions in predetermined areas at the installation site, which simplifies the assembly. In this case, the suspension device has a constructively simple design.

Two of the receiving regions may be constructed on the base element, and the position of the receiving devices can be adjusted by the adjusting device.

However, it may be expedient for two of the receiving regions to be constructed on the base element and for the position of one receiving region and the size of the other receiving region to be adjustable by the adjusting device. This is particularly advantageous when one of the receiving regions of the base element, in an interplay with one of the suspending elements, forms a fixed bearing, and when the other of the receiving regions of the base element, in an interplay with another of the suspending elements, forms a movable bearing. In this simple manner, one defined fixed bearing and one movable bearing, respectively, are formed with a given tolerance whose position and/or size can, in addition, be adapted in a simple manner to the installation situation.

It is within the scope of the present disclosure for two movable bearings and two fixed bearings to be alternately constructed on the base elements arranged side-by-side on the building.

The position and/or the size of the movable bearing and/or of the fixed bearing may be adjusted on the base element by the adjusting device.

It is advantageous for the position and/or the size of the movable bearing and/or of the fixed bearing on the base element to be adjustable horizontally parallel to the façade plane by the adjusting device in order to be able to easily vary the position of the movable bearing and of the fixed bearing in this direction, for compensating tolerances and take into account the installation situation.

Other aspects of the present disclosure will become apparent from the following descriptions when considered in conjunction with the accompanying drawings.

BRIEF DESCRIPTION OF THE DRAWINGS

FIG. 2 is a lateral view of the arrangement of FIG. 1.

FIG. 3 is a top view of a connection area between two façade elements, in accordance with the present disclosure.

FIG. 4 is a view of a coordinate system on a façade element, in accordance with the present disclosure.

DETAILED DESCRIPTION

Figure 1:
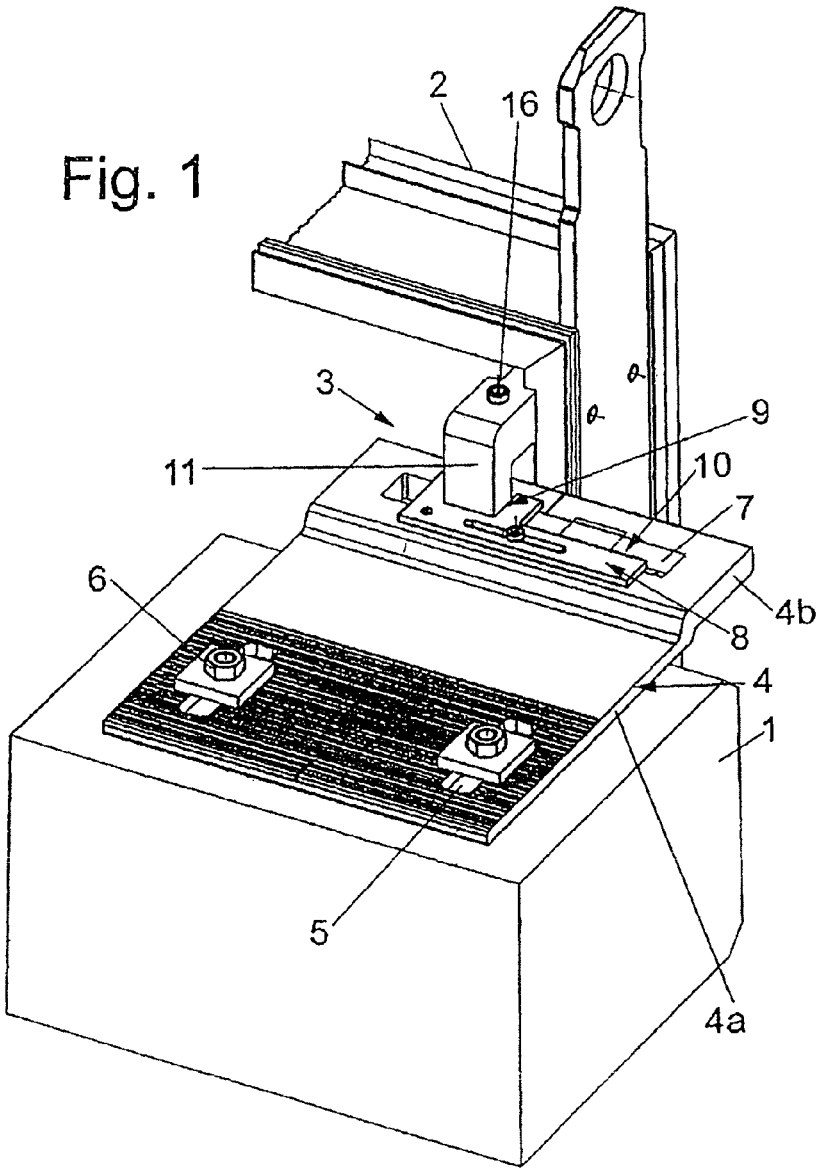
FIG. 1 is a perspective view of a first embodiment of a suspension device on a section of a floor slab and with a section of a suspended façade element, in accordance with the present disclosure.

FIG. 1 illustrates a floor ceiling, or floor slab, 1 of a building (not shown). An outer cover is formed by a façade having façade elements 2, as shown, for example, in FIGS. 1 and 3. Facade elements 2 are fastened to the floor slab 1 of the building by a suspension device 3 designed for this purpose. Only a frame of the façade element 2 is shown, which frame is used for receiving plane elements, such as glass panes (not shown).

As shown in FIG. 4, a plane of the façade elements is the X-Y plane as represented in FIGS. 2 and 3, in a normal vertical alignment of the façade, the vertical direction is indicated by ±Y, the horizontal direction situated parallel to the façade plane is indicated by ±X, and the horizontal direction situated perpendicular with respect to the façade is indicated by ±Z.

The suspension device 3 includes one or more elements 11, 12 arranged on the building side, which elements 11, 12 interact with one or more of the façade elements 2.

The embodiment shown in FIGS. 1-4 may, according to the present disclosure, be arranged in a different manner such as in a reverse arrangement.

The elements of the façade suspension on the building side, according to FIG. 1, include a base element 4 which is fastened to the building, for example, to an outer edge of the floor slab 1.

In the embodiment as shown in FIG. 1, the base element is shown as a base plate 4, which rests flatly by way of a first section 4*a* on the top side of the floor slab 1 and, with a further section 4*b*, projects laterally beyond the outer edge of the floor slab 1 to the outside.

The fastening of the base plate 4 to the floor slab 1 may take place in an arbitrary manner. Advantageous fastening devices may include a combination of recesses, for example, oblong holes 5, in the base plate 4 and screwing devices 6 for a screwing onto the floor slab 1.

The oblong holes 5 may be aligned in the Z-direction, for example, perpendicularly to the façade, and, as a result of the displacement relative to the screwing devices 6, permit a adjusting of the suspension device 3 with the façade elements 2 suspended therein in the Z-direction.

In the section 4*b* of the base plate 4 projecting beyond the outer edge of the floor slab 1, the base plate 4 is provided with at least one recess, for example, an oblong hole 7, which here extends parallel to the outer edge of the floor slab or parallel to the façade elements 2 to be suspended. Oblong hole 7 extends in the X-direction. It is within the scope of the present disclosure to divide the oblong hole 7 into several shorter oblong holes. However, an embodiment with only a single oblong hole 7, by which the tolerances can be compensated in the X-direction, may be advantageous.

An adjusting device 8 is arranged on the base element, for example, the base plate 4 in a movable manner relative to the base plate 4.

The adjusting element 8 is constructed as an element that is F-shaped in a top view and has a base leg 8*a* as well as two transverse legs 8*b*, 8*c* extending perpendicularly with respect to the base leg 8*a*.

The base leg 8*a* is aligned parallel to the oblong hole 7 and partially rests on the material of the base plate 4 and partially projects with its edge into the area of the oblong hole 7, so that it covers the latter in a strip-shaped area.

The transverse legs 8*a*, 8*b* may extend beyond the edge of the oblong hole 7 situated opposite the base leg 8*a* and rest on the base plate 4.

The oblong hole 7 in the base plate 4, on the one hand, and the legs 8*a, b, c*, of the adjusting device, on the other hand, form receiving regions 9, 10 for the suspending elements 11, 12 on the façade elements 2, which are further developed like L-shaped hook elements whose longitudinal legs engage vertically in the downward direction in the receiving regions 9 and 10 respectively.

One receiving region 9 is bounded on two sides by the two transverse legs 8*b*, 8*c*, on one side by the area of the longitudinal leg 8*a* situated between the transverse legs 8*b*, 8*c*, and, on the fourth side by the edge of the oblong hole 7.

The other receiving region 10 is bounded on one side by the transverse leg 8*c*, on one side by the remaining area of the longitudinal leg 8*a* and, on its two additional sides, by two edges of the oblong hole 7.

In an embodiment according to the present disclosure, the two suspension regions 9, 10 each have a rectangular shape in a top view, the rectangles having a different length parallel to the façade plane. The receiving region 9 is shown, for example, shorter in the X-direction than the receiving region 10, because the receiving region 9 is used for a fixed bearing and the receiving region 10 is used for a movable bearing.

The hook-shaped suspending elements 11, 12 of the façade elements 2 to be suspended engage in the two receiving regions 9, 10. In such a case, not two suspending elements of an individual façade element 2 engage in the receiving regions 9, 10 of a base plate 4, but edge-side suspending elements 11, 12 of adjacent façade elements 2, which is shown in FIG. 3.

For the suspension of each façade element 2, only two base elements or base plates 4 with two adjusting elements 8 are required.

According to the present disclosure, one of the suspending elements 11 of each façade element 2, in an interplay with one of the receiving regions 9, forms a fixed bearing, and the other of the suspending elements 12 forms a movable bearing, because the suspending element 12 engages with play in the pertaining receiving region 10.

In order to be able to change or define particularly the position of the fixed bearing within the given tolerances, it is provided to arrange the adjusting element 8 to be adjustable, especially displaceable, at least parallel to the oblong hole 7 or to the façade plane, on the base plate 4. This may be implemented in that the adjusting element 8 has an oblong hole 13 which is penetrated by a screw 14 screwed into a screw hole of the base plate 4. By a further element, which is constructed as a screw 17 or as a pin or the like and penetrates corresponding openings in the adjusting element 8 and in the base plate 4, the adjusting element, which may be additionally protected against twisting, after its alignment, is fastened to the base plate 4.

For a mounting, the base plates 4 are first fastened to the floor slab 1. Then the façade elements 2 are suspended with their suspending elements 11, 12 into the oblong holes 7, and then, after the alignment of the façade elements 2, the adjusting element 8 is placed on the base plate 4 and is locked there.

A projection 15 may be provided on the suspending element, for example, element 11, and is dimensioned such that, after the placing of the adjusting device 8, it prevents a lifting of this suspending element 11 out of a pertaining receiving region, for example, region 10.

An adjusting of the façade elements 2 in the vertical Y-direction can be implemented via adjusting screws 16 that are arranged at the hook-shaped suspending elements 11, 12 in screw holes of these elements. The adjusting screws 16 are supported on the base plate 4 so that, by adjusting these screws 16, it is within the scope of the present disclosure, to adjust the vertical height of the façade elements 2.

It is within the scope of the present disclosure, when the transverse legs are spaced correspondingly, to design the adjusting device 8 not in an F-shape but in an E-shape, with an eccentric "intermediate" transverse leg. It is also within the scope of the present disclosure to change the "E" to a "B" or the like.

It is also within the scope of the present disclosure to divide the adjusting device 8 into several individual elements. However, such a selected arrangement may be advantageous because it is particularly easy to handle.

Summarizing, in this manner, a simple mounting of the façade elements 2 on a façade is possible as well as a three-dimensional alignment, in which case a fixed bearing and a movable bearing are provided so that, changes are absorbed which are caused, for example, by temperature fluctuations.

It should also be noted that the receiving regions 9, 10 could, according to the present disclosure, have a geometry that deviates from a rectangular shape. The receiving region 10 may be constructed as a fixed bearing and could have an oval or circular or dovetailed geometry, if the suspending elements 11, 12 are shaped correspondingly.

While, according to the illustrated embodiment, movable bearings and fixed bearing alternate in each case in the X-direction, so that one movable bearing and one fixed bearing, respectively, are implemented at each base plate 4, it is also within the scope of the present disclosure to alternately construct two movable bearings and two fixed bearings, respectively, on base plates 4 situated side-by-side. In this case, an E-shaped adjusting element can be aligned and fastened on one of the base plates 4, which adjusting element forms the fixed-bearing receiving devices, and only one oblong hole for constructing the movable bearings is constructed on the respectively next base plate. This may be supplemented by a strip which can, for example, be screwed on and which secures the projection against a falling out (not shown).

It is within the scope of the present disclosure to divide the base plate 4 into several plates. However, a one-piece variant may be preferred because it is particularly simple.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A suspension device for façade elements of a façade of a building, the suspension device comprising:

suspending elements engaging in receiving regions of elements of the suspension device that are arranged on the building side;

the elements of the suspension device arranged on the building side include at least one base element that is fastened to the building and an adjusting device that is adjustable on the base element;

two of the receiving regions are constructed on the at least one base element and a position of a first of the receiving regions and a size of a second of the receiving regions is adjustable by the adjusting device; and the first receiving region cooperates with a first of the suspending elements to form a fixed bearing and the second of the receiving regions cooperates with the second of the suspending elements to form a movable bearing.

2. The suspension device according to claim 1, wherein a position of the second of the receiving regions and a size of the first of the receiving regions are configured to be adjusted by the adjusting device.

3. The suspension device according to claim 2, where the at least one base element includes two base elements, and two movable bearings and two fixed bearings are constructed on the two base elements arranged side-by-side on the building.

4. The suspension device according to claim 1, wherein one or both of the position and the size of one or both of the movable bearing and the fixed bearing are configured to be adjusted by the adjusting device.

5. The suspension device according to claim 1, wherein one or both of the position and the size of one or both of the movable bearing and the fixed bearing are configured to be horizontally adjusted parallel to a façade plane by the adjusting device.

6. The suspension device according to claim 5, wherein the at least one base element is constructed as a base plate.

7. The suspension device according to claim 6, wherein the base plate is arranged perpendicularly to the façade plane in a horizontally adjustable manner on the building.

8. The suspension device according to claim 6, wherein the base plate rests flatly with a first section on a top side of a floor slab and projects laterally with a further section beyond an outer edge of the floor slab.

9. The suspension device according to claim 8, wherein in a region of the base plate projecting beyond the outer edge of the floor slab, the base plate includes a recess extending parallel to one of the outer edge of the floor slab and parallel to the façade elements, which recess is constructed as an oblong hole.

10. The suspension device according to claim 9, wherein the adjusting device is constructed as an F-shaped element which includes one base leg and two transverse legs.

11. The suspension device according to claim 10, wherein the transverse legs extend beyond an edge of the oblong hole situated opposite the base leg.

12. The suspension device according to claim 9, wherein the oblong hole in the base plate and the legs of the adjusting device form the receiving regions.

13. The suspension device according to claim 9, wherein the adjusting device is configured to adjust the base plate at least parallel to the oblong hole.

14. The suspension device according to claim 6, wherein a fastening of the base plate on the floor slab takes place by fastening devices which are formed of a combination of oblong holes in the base plate and screwing devices for the screwing to the floor slab.

15. The suspension device according to claim 6, wherein the base plate and the adjusting device are movable relative to one another.

16. The suspension device according to claim 6, wherein the adjusting device includes an oblong hole configured to be penetrated by a screw which is fastened in the base plate.

17. The suspension device according to claim 1, wherein the adjusting device is constructed as an E-shaped element as viewed in a top view.

18. The suspension device according to claim 1, wherein the suspending elements are shaped as L-shaped hook elements which, by way of longitudinal legs, engage in a vertically downward direction in the receiving regions.

19. The suspension device according to claim 1, wherein each of the two receiving regions has a different length parallel to a façade plane in an X-direction.

20. The suspension device according to claim 1, further including a mechanism configured to adjust the façade elements in a vertical direction.

21. The suspension device according to claim 1, wherein a projection is included on at least one of the suspending elements, which projection is dimensioned and configured to prevent a lifting-out of the suspending element.

22. A façade including façade elements and the suspension device of claim 1.

* * * * *